US005660112A

United States Patent [19]

Theurer

[11] Patent Number: 5,660,112

[45] Date of Patent: Aug. 26, 1997

[54] WORK CAR FOR TRACK MAINTENANCE OPERATIONS

[75] Inventor: Josef Theurer, Vienna, Austria

[73] Assignee: Franz Plasser Bahnbaumaschinen-Industriegesellschaft M.B.H., Vienna, Austria

[21] Appl. No.: 608,845

[22] Filed: Feb. 27, 1996

[30] Foreign Application Priority Data

Mar. 16, 1995 [AT] Austria ..... A 471/95

[51] Int. Cl.[6] ..... E01B 29/00

[52] U.S. Cl. ..... 104/2

[58] Field of Search ..... 104/2, 4, 5, 7.1, 104/7.2, 7.3, 8, 12, 16, 17.1, 17.2

[56] References Cited

U.S. PATENT DOCUMENTS

| | | | |
|---|---|---|---|
| 3,722,423 | 3/1973 | Plasser et al. | 104/7.3 |
| 3,943,957 | 3/1976 | Theurer | 104/7.1 |
| 3,968,752 | 7/1976 | Theurer | 104/12 |
| 4,165,694 | 8/1979 | Theurer | 104/7.3 |
| 4,257,331 | 3/1981 | Theurer et al. | 104/2 |
| 4,356,771 | 11/1982 | Theurer | 104/12 |
| 4,502,389 | 3/1985 | Theurer et al. | 104/2 |
| 4,630,541 | 12/1986 | Theurer et al. . | |
| 5,046,270 | 9/1991 | Theurer et al. | 104/7.2 |
| 5,172,637 | 12/1992 | Theurer et al. | 104/7.1 |
| 5,301,548 | 4/1994 | Theurer . | |

*Primary Examiner*—Mark T. Le
*Attorney, Agent, or Firm*—Collard & Roe, P.C.

[57] ABSTRACT

A work car for carrying out track maintenance operations, comprising a chassis with a coupling for detachably coupling the chassis to another car running on a track, undercarriages supporting the chassis on the running surfaces of the rails, at least one track maintenance operating device on the chassis, the device comprising hydraulically operable drives, a hydraulic fluid supply line, a hydraulic coupling at one end of the chassis for connecting the hydraulic fluid supply line thereto, and the chassis defining an upper boundary spaced from the running surfaces of the rails a distance not exceeding four meters in the region of the one chassis end and a distance not exceeding three meters at an end of the chassis opposite the one end.

8 Claims, 2 Drawing Sheets

WORK CAR FOR TRACK MAINTENANCE OPERATIONS

BACKGROUND OF THE INVENTION

1. Field of the Invention

The present invention relates to a work car for carrying out track maintenance operations.

2. Description of the Prior Art

U.S. Pat. No. 5,301,548 discloses a track measuring car. This work car has a chassis supported by undercarriages on the track and is moved to an operating site coupled to a track tamping machine. At the operating site, it is moved independently by its own drive. A small carriage is detachably coupled to a front end of the work car and is also independently movable. A laser beam transmitter is mounted on this small carriage. To provide a clear view to an operator in the cab of the track tamping machine during movement to the operating site, the measuring car chassis defines an inclined upper limiting plane enclosing an angle with the track plane.

U.S. Pat. No. 4,630,541 discloses a track tamping machine comprising a main frame continuously moving along the track during a tamping operation and a satellite frame intermittently moving from tamping stage to tamping stage. The satellite frame carries a vertically adjustable tamping unit and a track lifting and lining unit, and according to one embodiment, this satellite frame may precede the main frame in the operating direction. The frames are interconnected by a longitudinally adjustable coupling device which imparts to the satellite frame the required acceleration and deceleration enabling it to move intermittently while the main frame moves continuously.

SUMMARY OF THE INVENTION

It is the primary object of this invention to provide a simply constructed work car for rapidly carrying out relatively limited track maintenance operations extending over a short period.

The above and other objects are accomplished according to the invention with a work car which comprises a chassis with a coupling means for detachably coupling the chassis to another car running on a track comprising two rails having running surfaces, and undercarriages supporting the chassis on the running surfaces of the rails. At least one track maintenance operating device is mounted on the chassis, the device being selected from the group consisting of a ballast tamping unit, a track stabilization unit, a ballast plow, a ballast broom, a track lifting and lining unit, a ballast suction apparatus, a track measuring system, a tie exchange apparatus and a rail grinding apparatus, and comprising hydraulically operable drive means. A hydraulic coupling at one end of the chassis connects a hydraulic supply line thereto, and the chassis defines an upper boundary spaced from the running surfaces of the rails a distance not exceeding four meters in the region of the one chassis end and a distance not exceeding three meters at an end of the chassis opposite the one end.

Such a work car may be readily coupled to a locomotive or any type of driven track maintenance car without requiring its own drive so that it may be used for carrying out short-term and locally limited track maintenance operations which do not economically justify the use of large and efficient machines. For example, if the work car is used for a tie exchange operation, the new ties required for the exchange and the old ties removed from the track may be transported on a loading platform provided on the driven car to which the work car is coupled. Since the work car is not limited to any specific type of locomotive or driven track maintenance car, it can be used in a great variety of ways in connection with vehicles available at the operating site, including simple locomotives.

BRIEF DESCRIPTION OF THE DRAWING

The above and other objects, advantages and features of the invention Will become more apparent from the following description of certain now preferred embodiments thereof, taken in conjunction with the accompanying, somewhat schematic drawing wherein.

DETAILED DESCRIPTION OF THE PREFERRED EMBODIMENTS

Figure 1:
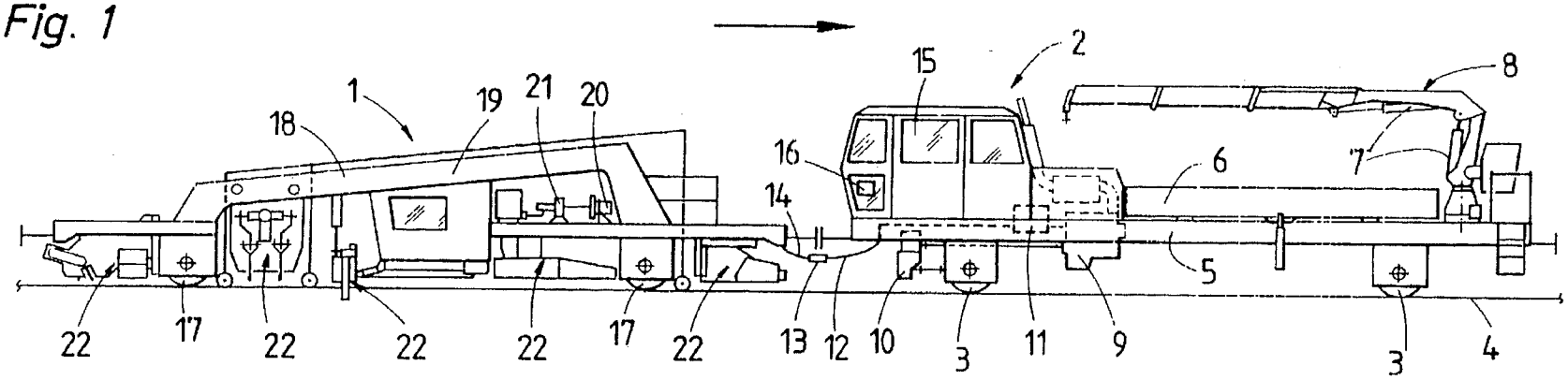
FIG. 1 is a side elevational view of one embodiment of a work car according to the invention, which is detachably coupled to a driven car used in track maintenance operations.
Figure 2:
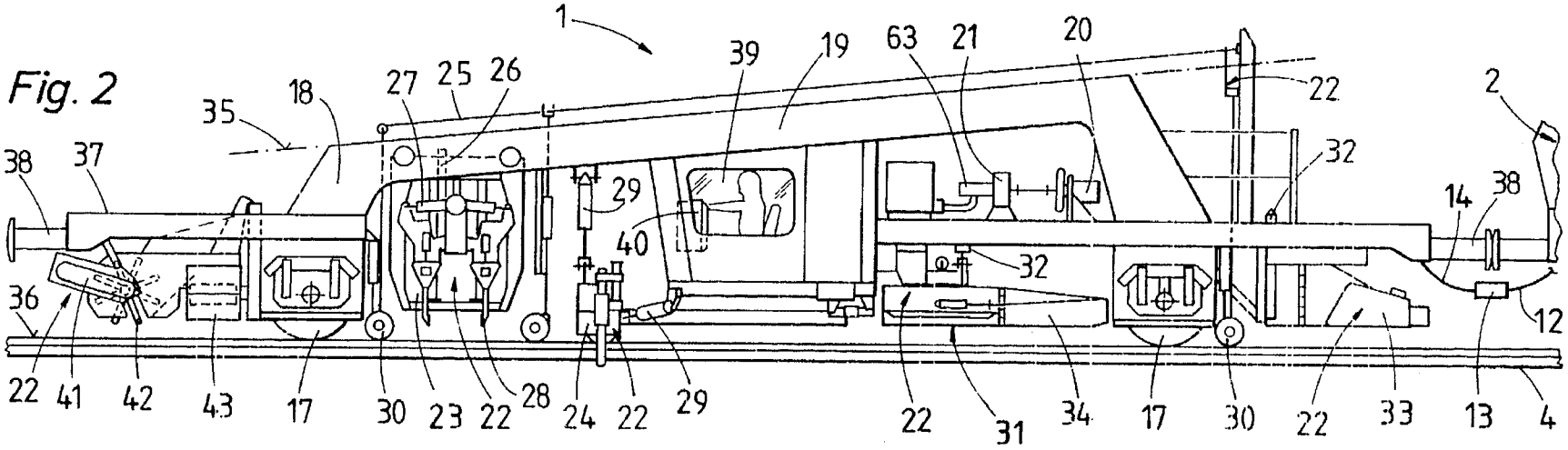
FIG. 2 is an enlarged side elevational view of the work car of FIG. 1.

Referring now to the drawing and first to FIGS. 1 and 2, there is shown work car 1 for carrying out track maintenance operations detachably coupled to driven car 2 used in track maintenance. Car 2 comprises frame 5 supported on track 4 by undercarriages 3. Frame 5 supports loading platform 6 and crane 8 vertically and transversely adjustable by drives 7. Motor 9 has a drive shaft connected to the wheels of one of the undercarriages by transmission 10 to drive car 2 along the track. Motor 9 may selectively operate hydraulic fluid pump 11 which is connected by hydraulic fluid line 12 which may be connected by hydraulic coupling 13 at one end of chassis 18 of work car 1 to hydraulic fluid supply line 14. Operator's cab 15 is mounted at an end of frame 5 facing work car 1 and holds control 16.

Work car 1 comprises chassis 18 with coupling 38 of the chassis for detachably coupling the chassis to car 2 running on track 4 comprising two rails having running surfaces 36. As shown in the drawing, couplings 38 are provided at both ends of the chassis to enable work car 1 to be incorporated in a train of cars. Front and rear undercarriages 17 at the ends of chassis 18, in the operating direction of the work car indicated by an arrow in FIG. 1, support chassis 18 on the running surfaces of the rails. The illustrated chassis has an inclined elongated carrier 19 enclosing an acute dihedral angle with a plane defined by the rails whereby the chassis is upwardly recessed. Hydraulic motor 20 is connected to hydraulic fluid supply line 14 and receives the hydraulic fluid therefrom when motor 9 operates hydraulic fluid pump 11. The hydraulic motor has a drive shaft, hydraulic fluid distributor transmission 21 is connected to the drive shaft, and hydraulic fluid pumps 63 are connected to transmission 21 for feeding the hydraulic fluid to the drive means for operating devices 22 on chassis 18 of work car 11. At least one such track maintenance operating device is mounted on the chassis. Depending on the desired operation, device 22 is selected from the group consisting of a ballast tamping unit 23, a track stabilization unit 60, a ballast plow 31, a ballast broom 42, a track lifting and lining unit 24, a ballast suction apparatus 54, a track measuring system 25, a tie exchange apparatus 61 and a rail grinding apparatus 50. Hydraulically operable drive means of respective operating devices 22 are operated by the hydraulic fluid supplied by pumps 63. Chassis 18 defines an upper boundary 35 spaced from running surfaces 36 of the rails a distance not exceeding four meters in the region of the one chassis end and a distance not exceeding three meters at an end of the chassis opposite the one end.

As shown in FIGS. 1 and 2, operator's cab 39 is mounted on elongated carrier 19 of chassis 18, and central control 40 in cab 39 is provided for operating the drive means of operating devices 22.

In the embodiment shown in FIG. 2, the following operating devices 22 are sequentially arranged on chassis 18 in a direction extending from the one to the opposite end: a ballast plow 31 comprising vertically adjustable plow 33 centered between the rails and arranged forwardly of front undercarriages 17, and two transversely spaced, transversely and vertically adjustable track shoulder plows 34 arranged immediately rearwardly of the front undercarriage and forwardly of operator's cab 39, a track lifting and lining unit 24 followed by a tamping unit 23 arranged between operator's cab 39 and rear undercarriage 17, and a vertically adjustable and rotatable ballast broom 42 arranged immediately rearwardly of the rear undercarriage. These operating devices may be used selectively and/or consecutively, as desired. For example, spot ballast tamping may be effected by operating drive 26 to lower vertically adjustable tamping unit 23 into the ballast so that vibratory tamping tools 28 are immersed in the ballast, whereupon reciprocating drives 27 are operated to squeeze the ballast between the tamping tools under the track ties. If the position of track 4 is to be corrected, drives 29 are operated to reposition the track vertically and/or laterally under the control of track measuring system 25 which comprises a tensioned wire supported on rollers 30 running on the track rails. The ballast bed may be shaped by operating drives 32 for vertically adjusting ballast plow 33 and transversely and/or vertically adjusting shoulder plows 34. Ballast may be swept by operating drive 41 to rotate vertically adjustable broom 42 at rear end 37 of chassis 18, and the swept-up ballast is conveyed to one of the track shoulders by transverse conveyor band 43 which receives the swept-up ballast from rotating broom 42.

In FIGS. 3 to 7, like reference numerals are used to designate like parts functioning in a like manner as in FIGS. 1 and 2.

Figure 3:
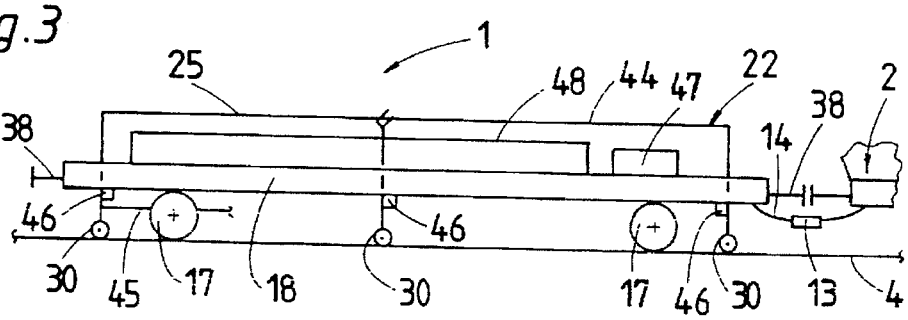
FIGS. 3 to 7 schematically illustrate different embodiments of the work car.

In FIG. 3, work car 1 is a track measuring car carrying as operating device 22 only track measuring system 25. This measuring system comprises a tensioned wire 44 extending over each rail for measuring track level errors and further tensioned wire 45 for measuring lining errors. The tensioned wires are supported on three pairs of sensing rollers 30 running on the track rails. Drives 46 are operated to adjust the sensing rollers vertically. Recording instrument 47 records the errors determined by system 25. A loading platform 48 on the chassis serves for transport. Such a track measuring car may be used in conjunction with other track measuring devices, such as superelevation measurements, track gage measurements, etc.

Figure 4:
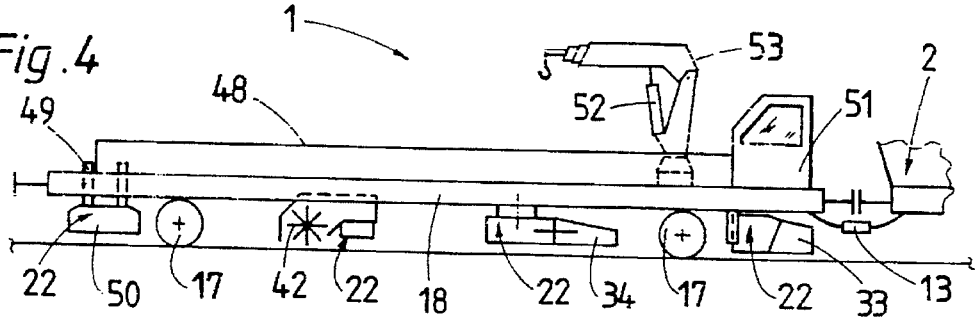

Work car 1 shown in FIG. 4 is a ballast plow serving to shape the ballast bed in the manner described in connection with FIG. 2. In addition, the work car carries rail grinding apparatus 50 vertically adjustable by drives 49 at an end of the chassis opposite center plow 33. Operator's cab 51 is arranged on the chassis above the center plow, and loading crane 53 on the chassis is vertically and transversely adjustable by drives 52. Furthermore, loading platform 48 serves for transport.

Figure 5:
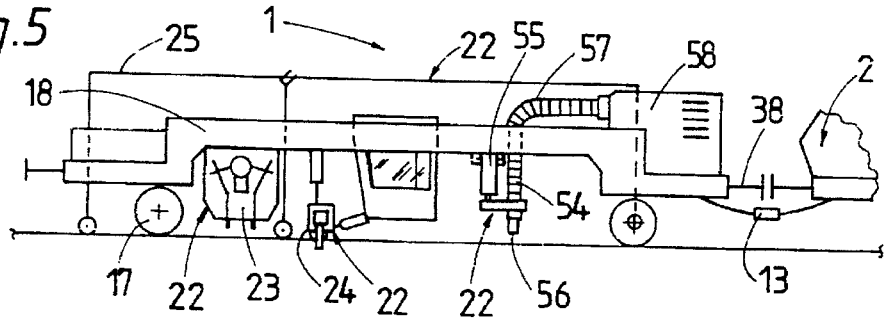

In work car 1 shown in FIG. 5, operating devices 22 include ballast tamping unit 23, track lifting and lining unit 24, and ballast suction apparatus 54 comprising vacuum generating device 58, flexible vacuum conduit 57 connected to the vacuum generating device, and suction nozzle 56 mounted on the flexible vacuum conduit. Drives 55 are connected to the suction nozzle to adjust the nozzle vertically and/or transversely.

Figure 6:
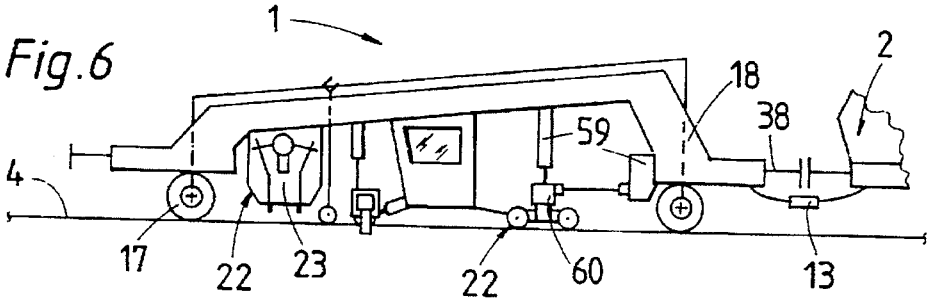

The work car illustrated in FIG. 6 carries vibratory track stabilization unit 60 which may be vertically adjusted by drives 59. Preferably, this unit is operated to provide controlled settling of the track in the ballast to provide a desired track level after the ballast has been tamped by tamping unit 23.

Figure 7:
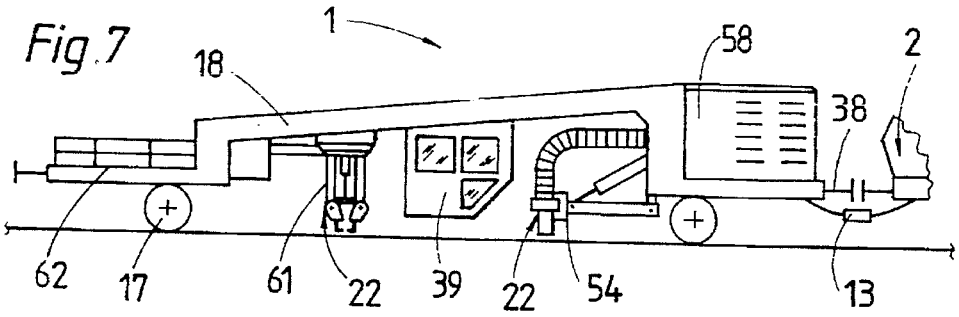

Work car 1 of FIG. 7 is a tie exchange car carrying tie exchange apparatus 61 as operating device 22. Loading platform 62 serves to transport the old and new ties.

What is claimed is:

1. A work car for carrying out track maintenance operations, which comprises (a) a chassis with a coupling means for detachably coupling the chassis to another car running on a track comprising two rails having running surfaces, (b) undercarriages supporting the chassis on the running surfaces of the rails, (c) at least one track maintenance operating device on the chassis, the device (1) being selected from the group consisting of a ballast tamping unit, a track stabilization unit, a ballast plow, a ballast broom, a track lifting and lining unit, a ballast suction apparatus, a track measuring system, a tie exchange apparatus and a rail grinding apparatus, and (2) comprising hydraulically operable drive means, (d) a hydraulic fluid supply line, (e) a hydraulic coupling at one end of the chassis for connecting the hydraulic fluid supply line thereto, (f) the chassis defining an upper boundary spaced from the running surfaces of the rails a distance not exceeding four meters in the region of the one chassis end and a distance not exceeding three meters at an end of the chassis opposite the one end, and (g) a hydraulic motor connected to the hydraulic fluid supply line and receiving the hydraulic fluid therefrom, the hydraulic motor having a drive shaft, a hydraulic fluid distributor transmission connected to the drive shaft, and hydraulic fluid pump means connected to the transmission for feeding the hydraulic fluid to the drive means.

2. The work car of claim 1, further comprising an operator's cab on the chassis, and a central control in said cab for operating the drive means.

3. The work car of claim 1, wherein the chassis is supported by undercarriages at the ends of the chassis, and including a tamping unit and a track lifting and lining unit arranged on the chassis between the undercarriages, and a track measuring system for measuring the position of the track.

4. The work car of claim 1, including a ballast plow comprising two transversely spaced, transversely and vertically adjustable track shoulder plows.

5. The work car of claim 1, including a ballast plow comprising a vertically adjustable plow centered between the rails.

6. The work car of claim 1, wherein the chassis is supported by a front undercarriage at the one end and a rear undercarriage at the opposite end, an operator's cab is mounted on the chassis, a central control is provided in said cab for operating the drive means, and the following operating devices are sequentially arranged on the chassis in a direction extending from the one to the opposite end: a ballast plow comprising a vertically adjustable plow centered between the rails and arranged forwardly of the front undercarriage, and two transversely spaced, transversely and vertically adjustable track shoulder plows arranged immediately rearwardly of the front undercarriage and forwardly of the operator's cab, a track lifting and lining unit followed by a tamping unit arranged between the operator's cab and the rear undercarriage, and a vertically adjustable and rotatable ballast broom arranged immediately rearwardly of the rear undercarriage.

7. The work car of claim 1, including a ballast suction apparatus comprising a vacuum generating device, a flexible vacuum conduit connected to the vacuum generating device, and a suction nozzle mounted on the flexible vacuum conduit.

8. A work car for carrying out track maintenance operations, which comprises (a) a chassis with a coupling means for detachably coupling the chassis to another car running on a track comprising two rails having running surfaces, (b) undercarriages supporting the chassis on the running surfaces of the rails, (c) at least one track maintenance operating device on the chassis, the device (1) being selected from the group consisting of a ballast tamping unit, a track stabilization unit, a ballast plow, a ballast broom, a track lifting and lining unit, a ballast suction apparatus, a track measuring system, a tie exchange apparatus and a rail grinding apparatus, and (2) comprising hydraulically operable drive means, (d) a hydraulic fluid supply line, (e) a hydraulic coupling at one end of the chassis for connecting the hydraulic fluid supply line thereto, and (f) the chassis having an inclined elongated carrier enclosing an acute dihedral angle with a plane defined by the rails whereby the chassis is upwardly recessed, and the elongated carrier defining an upper boundary spaced from the running surfaces of the rails a distance not exceeding four meters in the region of the one chassis end and a distance not exceeding three meters at an end of the chassis opposite the one end.

* * * * *